United States Patent [19]

Schuplin

[11] Patent Number: 4,479,341

[45] Date of Patent: Oct. 30, 1984

[54] CLIPS FOR T-BAR GRID CEILING ARRANGEMENT

[75] Inventor: Jerome T. Schuplin, Parma Heights, Ohio

[73] Assignee: Fastway Fasteners, Inc., Lorain, Ohio

[21] Appl. No.: 364,784

[22] Filed: Apr. 2, 1982

[51] Int. Cl.[3] ..... E04B 5/52

[52] U.S. Cl. ..... 52/665; 52/489; 52/712; 52/714

[58] Field of Search ..... 52/489, 665, 714, 712

[56] References Cited

U.S. PATENT DOCUMENTS

| | | | |
|---|---|---|---|
| 3,089,570 | 5/1963 | O'Neil | 52/665 X |
| 3,589,660 | 6/1971 | Dunckel | 52/714 X |
| 3,627,364 | 12/1971 | Van Riet | 52/665 X |
| 3,677,589 | 7/1972 | Roles | 52/665 X |
| 4,408,428 | 10/1983 | Brooke et al. | 52/489 |

FOREIGN PATENT DOCUMENTS

| | | | |
|---|---|---|---|
| 2143160 | 3/1973 | Fed. Rep. of Germany | 52/665 |
| 3048946 | 7/1982 | Fed. Rep. of Germany | 52/665 |

*Primary Examiner*—J. Karl Bell

*Attorney, Agent, or Firm*—Baldwin, Egan, Walling & Fetzer

[57] ABSTRACT

A clip for securing two T-bar grid beam members in generally perpendicular relation to one another in the formation of a ceiling grid for use, for instance, in a suspended ceiling. A plurality of clip embodiments are disclosed, each comprising a resilient fastener portion adapted for securing the clip to a primary T-bar beam member in generally snap-fastened relation, by forcing such resilient portion down over the head of the beam, and also another resilient fastener portion projecting laterally of the first fastener portion in generally perpendicular relation with respect thereto, and comprising resilient means for connecting a secondary T-bar beam member to the first mentioned beam member and in said perpendicular relationship. The clips may be formed of sheet material, such as sheet metal, and are adapted to be mass produced. The clips can be utilized with both the type of T-bar having a rectilinear head portion, as well as the type having a generally round head portion.

13 Claims, 10 Drawing Figures

CLIPS FOR T-BAR GRID CEILING ARRANGEMENT

This invention relates in general to a clip device adapted for use in a T-bar ceiling grid for connecting a primary T-bar beam member to a secondary or cross T-bar beam member and in generally perpendicular relationship, for use for instance in suspended ceilings and more particularly relates to a clip of the aforedescribed type which can be rapidly assembled in the field onto the T-bar beam members of the ceiling grid, for effectively holding them in generally assembled, relatively perpendicular relationship.

BACKGROUND OF THE INVENTION

Clips for securing two T-bar grid beam members in generally perpendicular relation to one another, in the formation of a ceiling grid are known in the art. U.S. Pat. No. 3,216,537 in the name of Nelsson, dated Nov. 9, 1965 and entitled "Clip Member for Suspended Ceiling Construction", discloses a clip arrangement wherein the clip portions connecting the main grid beam member to the secondary cross beam members are disposed in substantially longitudinal alignment.

U.S. Pat. No. 3,677,589 dated July 18, 1972 to Roles and entitled "Field Installation Clip for Exposed Grid Systems" discloses another clip for connecting T-bar grid members in generally perpendicular relation. Such clip arrangement requires openings in the T-bar members for receiving in coacting relationship in a part of the clip, for holding the grid members together, and thus requires custom made T-bar grid members.

U.S. Pat. No. 3,627,364 dated Dec. 14, 1971 in the name of Van Riet and entitled "Joint for Connecting Profiled Rods" discloses a resilient clip arrangement manufactured from sheet material, for connecting a pair of generally U-shaped section beam members (or rods) in generally perpendicular relationship.

Various other clips for use in suspended ceiling structures or the like are known in the art, such as, for instance, disclosed in U.S. Pat. Nos. 3,233,297; 3,390,495; 3,973,302; 4,019,300; 4,040,758; 4,266,384; and 4,272,937. These prior art clips have various obvious shortcomings as compared to applicant's present clip arrangements.

SUMMARY OF THE INVENTION

The present invention provides a clip arrangement for securing T-bar grid beam members in generally juxtaposed, generally perpendicular relation to one another, in the formation of a ceiling grid, for use in a suspended ceiling or the like, with the clip being adapted to be formed from sheet material, and comprising a resilient fastener portion adapted to be secured to a primary grid beam member in generally snap-fastened relation, and another fastener portion projecting laterally with respect to the first fastener portion in generally perpendicular relation thereto, and comprising resilient means adapted for coaction with a secondary grid beam member for effectively and rapidly connecting the beam members together in said generally perpendicular relation. The clip arrangement may be adapted for use with both the round headed type T-bar grid member as well as the rectilinear headed type T-bar grid member.

Accordingly, it is an object of the invention to provide a novel and improved clip for connecting together a pair of inverted T-bar grid beam members in generally perpendicular relation to one another, in the formation of a ceiling grid.

Another object of the invention is to provide a clip of the latter type which is inexpensive and can be mass produced.

A still further object of the invention is to provide a clip of the above type which comprises a resilient portion adapted to be secured to a primary grid beam member in generally snap-fastened relation, and with another clip portion projecting laterally of the first mentioned clip portion in generally perpendicular relation thereto and comprising resilient means adapted for coaction with a secondary grid beam member for connecting the secondary grid beam member to the primary beam member.

A still further object of the invention is to provide a clip of the above type which in plan is of generally L-shaped configuration, with the clip having clasp portions on each of the legs of the L, adapted to be forced downwardly into generally snap-fastened relation with respect to the associated beam member to attach the beam members together.

A still further object of the invention is to provide a clip of the aforementioned type which includes wings having generally vertically extending slots therein, adapted for receiving coaction with the primary grid beam and a projection oriented generally perpendicularly to the wing portions, and adapted to be received in generally snug frictional relation in the hollow head of the secondary beam, for attaching the grid beam members together.

A still further object of the invention is to provide a clip of the aforementioned type which includes a clip adapted to be forced down over the head of the primary grid beam member and having a pair of resilient generally C-chaped portions spaced laterally from one another and adapted to receive therebetween the vertical web of the secondary grid beam member, and to be engaged between the head of the secondary beam member and the laterally extending flange portions, for holding the grid beam members together in generally perpendicular relation.

Other objects and advantages of the invention will be apparent from the following description taken in conjunction with the accompanying drawings wherein:

DESCRIPTION OF PREFERRED EMBODIMENTS

Figure 3:
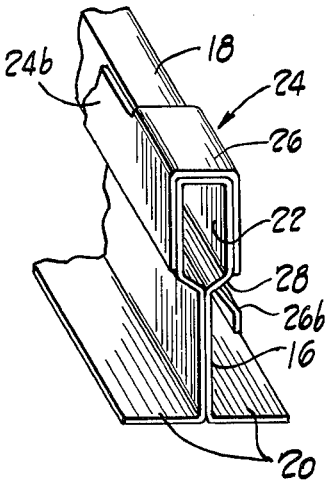
FIG. 3 is a fragmentary, perspective view illustrating the holding coaction of the partially severed tongue portion of the fastening section of the FIGS. 1 and 2 clip and its holding coaction with the head of the inverted T-shaped grid beam member.

Referring now again to FIGS. 1 through 3, there is illustrated a primary, inverted T-bar grid beam member 10 suspended, as by means of wire 12 from an upper support (not shown) in the formation of a grid structure for use for instance in a suspended ceiling or the like. A secondary inverted T-bar grid beam member 14 is adapted to be disposed in generally perpendicular juxtaposed relation to the grid member 10. As can be seen, the secondary grid member 14 is adapted to be supported on the adjacent underlying flange portion of the primary grid member.

Each of the grid members comprise a central web portion 16 extending generally vertically, an enlarged head portion 18, and foot or flange portions 20 projecting laterally from opposite sides of the web 16. In the embodiment illustrated, the head portion 18 is preferably hollow to define a generally longitudinally extending passageway 22 therethrough. However, it will be understood that for this FIGS. 1–3 embodiment of clip, the T-bars could be formed as solid pieces, such as for instance an extruded T-bar member without a hollow head portion. The head portion in the embodiment illustrated is of rectilinear configuration in cross section, as shown, but it also could be of generally circular configuration in cross section, the latter being well known, as shown for instance in the aforediscussed prior art.

Figure 1:
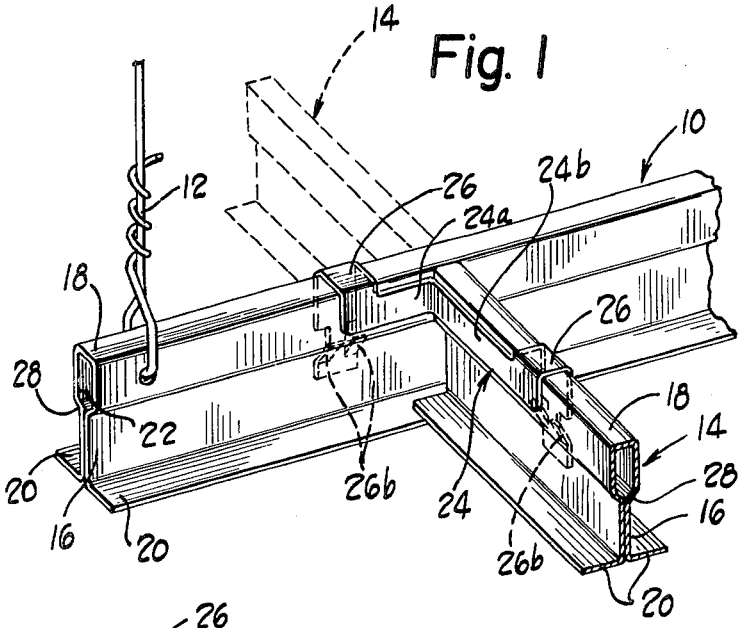
FIG. 1 is a fragmentary, perspective view of a primary grid beam member and a secondary grid beam member disposed in generally perpendicular relation and held in assembled condition by a clip embodying the invention. The clip illustrated is of the L-shaped configuration in plan, type clip; in dashed lines is illustrated another secondary beam member extending from the opposite side of the primary beam.
Figure 2:
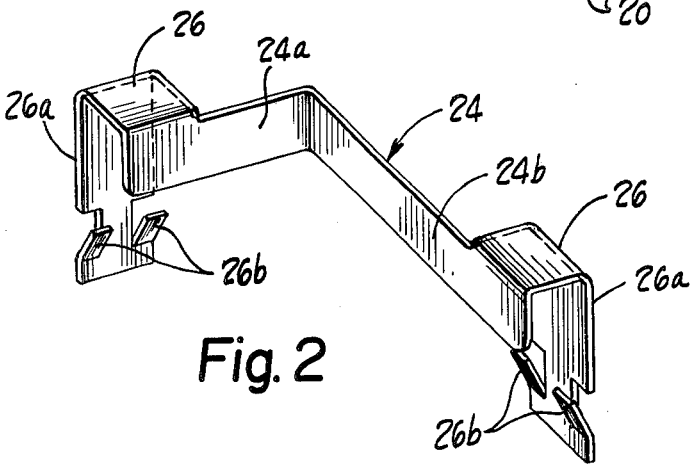
FIG. 2 is an enlarged, perspective view of the clip illustrated in FIG. 1.

A clip 24 is assembled with the grid beam members for holding the latter in generally perpendicular and generally juxtaposed relation to one another, as shown in FIG. 1 of the drawings, and with the secondary beam member 14 generally abutting the primary grid member 10 and supported at its end on the adjacent underlying flange 20 of the primary beam member 10.

This embodiment of clip is of generally L-shaped configuration in plan, and preferably comprises a shorter strap leg 24*a* and a longer strap leg 24*b*. The clip is preferably formed of sheet material such as for instance sheet metal, and may be stamped or cut from the sheet material using mass production techniques, well known in the art.

Each of the legs 24*a*, 24*b* of the clip 24 comprises a fastening section 26 for attaching the clip to the respective grid beam member. Fastening section 26 comprises a clasp 26*a* of generally inverted U-shaped configuration adapted to fit over the head of the respective T-bar grid member in generally snug relationship, and tongue portions 26*b* disposed obliquely so as to extend diagonally inwardly, with such tongues being preferably provided from partially severed portions of the clasp, and adapted for engaging the confronting inwardly sloped exterior under surface 28 (FIG. 3) of the head portion 18 of the respective grid beam member, when the clip is forced downwardly into generally snap-fastened relation with the respective grid member. One arm of the inverted U configuration of the clasp portion 26*a* is preferably longer than the other arm thereof with the tongue portions 26*b*, in the embodiment illustrated, formed from partially severed portions of the longer arm (FIG. 2) and with the shorter arm being generally coplanar with the respective strap leg 24*a* or 24*b*.

Thus it will be seen that the clip is fastened securely to the respective T-bar grid member in its assembled condition therewith, and is prevented from moving upwardly away from assembled relation by the abutting engagement of the generally resilient tongues 26*b* with the underside of the head portion 18 of the respective grid member. When assembled as illustrated in FIG. 1, the tongues 26*b* on the clasp sections 26*a* are adapted to generally bite into the engaged surface 28 and lock the clip to the associated grid beams. The grid structure is adapted for providing a grid support for ceiling panels or the like, in for instance a suspended ceiling. As shown in dashed lines, secondary grid beams may extend from opposite sides of primary beam 10, with there being a plurality (not shown) of the primary beams disposed in generally parallel relation, to form the grid.

Figure 4:
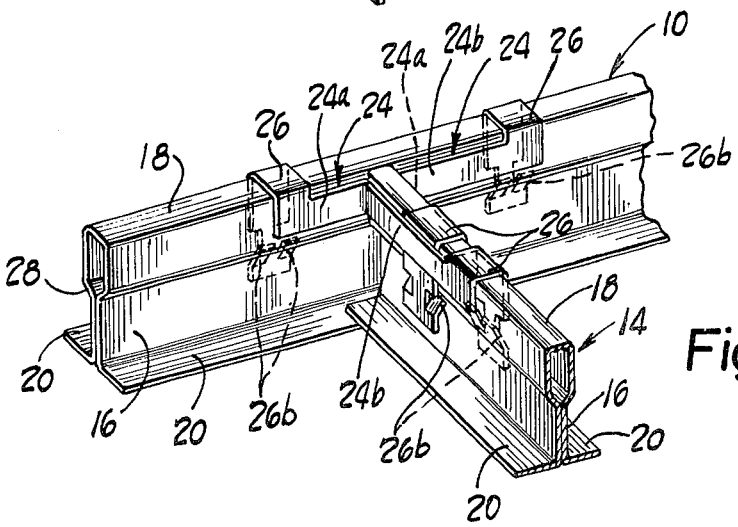
FIG. 4 illustrates the use of a pair of clips of the FIGS. 1 and 2 type, as utilized to connect a primary grid beam member and a secondary grid beam member together in generally perpendicular relation.

Referring now to FIG. 4, there is shown an assembly of a main or primary grid member 10 with secondary grid member 14, and wherein a pair of the clips 24 have been utilized to attach the grid members together, thus forming an even more stable connection of the grid members. In this regard it will be seen that the short leg 24*a* and associated fastener portion 26 of the additional clip coacts with the head of the secondary grid member 14, while the longer leg 24*b* and associated fastener portion 26 coacts with the main grid member 10, as opposed to the clip on the lefthand side wherein the short leg 24*a* and fastener section 26 coacts with the main grid beam while the longer leg 24*b* and associated fastener section 26 coacts with the secondary beam 14. The general flexibility of the clips enable the ready overlapping between the clips as illustrated in FIG. 4.

Figure 5:
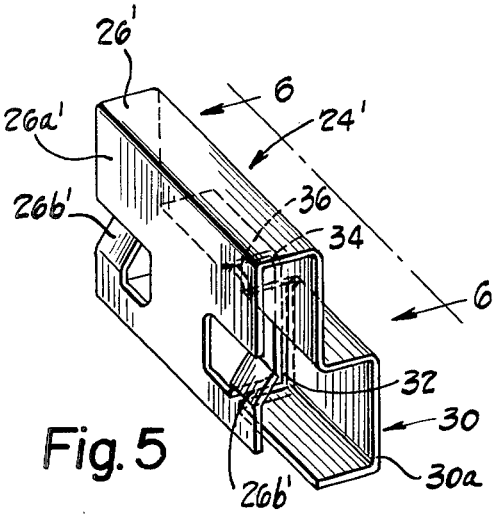
FIG. 5 is a perspective illustration of another embodiment of clip for connecting inverted T-bar grid beam members in generally perpendicular relation.
Figure 6:
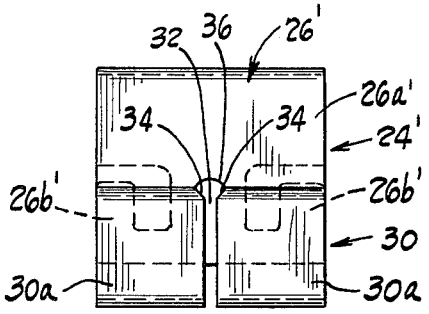
FIG. 6 is an elevational view of the FIG. 5 clip taken generally along the plane of line 6—6 of FIG. 5 looking in the direction of the arrows.
Figure 7:
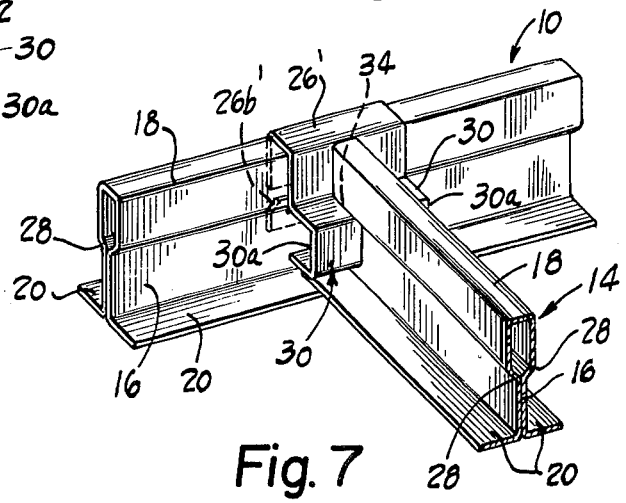
FIG. 7 is a fragmentary perspective view illustrating the FIGS. 5 and 6 clip connecting together a primary T-bar grid beam member with a secondary T-bar grid beam member.

Referring now to FIGS. 5, 6, and 7, there is shown another embodiment of clip for connecting a secondary grid member 14 (FIG. 7) to a primary grid member 10. The clip 24′ in this embodiment comprises a fastening portion 26′ adapted for being forced over the head portion of the main or primary grid member 10 into generally snap-fastened relationship with the grid member as shown in FIG. 7, and includes generally inverted U-shaped clasp 26*a*′ and spaced generally resilient tongues 26*b*′ formed from partially severed portions of the longer arm of the inverted U clasp, as shown, and bent so as to extend obliquely inwardly, so that the tongues bite or grip the confronting sloped undersurface 28 of the head 18 of the main grid beam 10.

Projecting generally perpendicularly from the fastening portion 26' is a generally resilient fastening portion 30 comprising a pair of spaced, generally C-shaped in elevation, fastener sections 30*a*, defining a slot 32 therebetween. The inner edges of the C-shaped fastening sections 30*a* are preferably beveled as at 34 (FIG. 6) for a purpose to be hereinafter set forth. The slot 32 defined by fastening sections 30*a* preferably terminates at the shorter arm of the inverted U of fastening section 26' in an arcuate defining edge 36.

It will be seen that the secondary grid member 14 is received in the slot defined by fastening sections 30*a*, with such sections 30*a* being disposed beneath the head portion 18 of the secondary grid member 14 and engaging the respective laterally projecting flange portions 20, in generally snug, gripping relationship, and with the head portion 18 of the secondary grid member 14 generally abutting the confronting exterior of the shorter leg of the inverted U-shaped fastening portion 26' and as shown in FIG. 7. The spaced C-shaped fastening sections 30*a* are more or less resilient, and generally grip the engaged web 16 of the secondary grid beam 14 with the aforementioned beveled surfaces 34 on the fastening sections 30*a*, engaging the sloped respective confronting undersurface 28 of the secondary grid member 14. Any withdrawal movement of the secondary grid member 14 from the abutting engagement with clip 24' is resisted by the resilient gripping of the web and underside of the head of the secondary beam member 14 by the spaced fastener portions or sections 30*a*. The secondary beam members extend of course between spaced parallel main beam members, and thus are restricted in their lengthwise and vertical movement relative to the main beam members. The tongues 26*b'* on the clip are adapted to bite into the head 18 of the main grid member 10, and prevent or resist movement of the clip relative to the main grid member.

Figure 8:
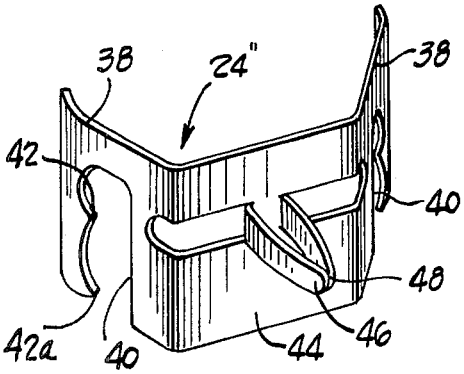
FIG. 8 is a perspective illustration of another embodiment of clip for connecting a primary T-bar grid beam member to a secondary T-bar grid beam member, and is of a type embodying wing portions and a resilient projecting portion.
Figure 9:
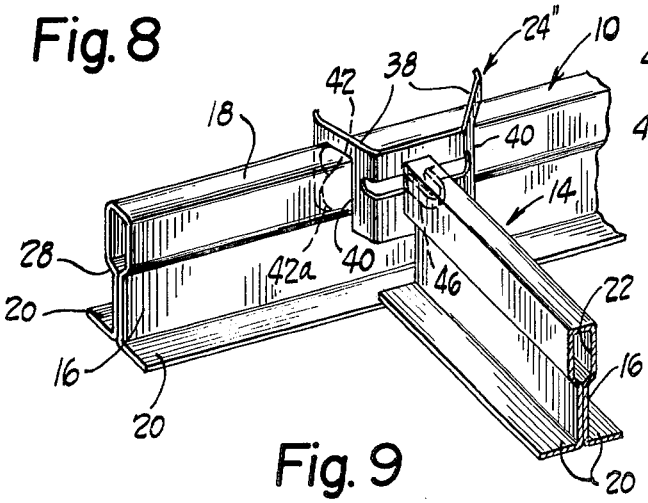
FIG. 9 is a fragmentary, perspective view illustrating the clip of FIG. 8 connecting a primary T-bar grid beam member to a secondary grid beam member, with the projection on the clip being received interiorly of the hollow head portion of the secondary grid beam member.
Figure 10:
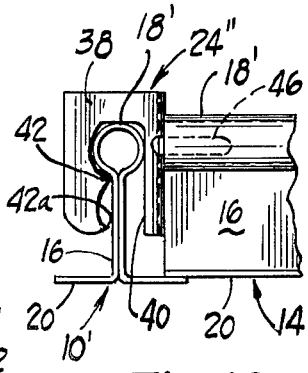
FIG. 10 is a fragmentary elevational view of a clip of the type of FIGS. 8 and 9 but showing it assembled with T-bar members having generally round hollow head portions as opposed to the generally rectangular hollow head portion T-bar members illustrated in FIG. 9.

Referring now to FIGS. 8 and 9, there is illustrated another embodiment of clip 24'' wherein the clip includes wing sections 38 having generally vertically oriented slots 40 therein, defined in part by vertically spaced tongues or barbs 42, 42*a*. Projecting generally perpendicularly outwardly from the frontal web 44 of the clip, and preferably formed from partially severed sections or strips thereof, is a male protuberance 46. The two partially severed strips are preferably formed into generally curved relationship as illustrated, for general engagement at their distal ends, as at 48, thus providing general lateral resilience or springyness to the projection 46. Projection or protuberance 46 is adapted to be received within the hollow interior passageway 22 of the secondary grid member 14, and as shown in FIG. 9, with such projection 46 being preferably received in generally snug-fitting frictional coaction with the defining interior surfaces of passageway 22, to thus frictionally hold the secondary grid member to the main or primary grid member 10. In the embodiment illustrated in FIG. 9, the tongue or barb 42*a* is adapted to engage or bite into the confronting generally sloped undersurface 28 of the rectilinear head portion 18 of the main or primary grid member 10. However, if the grid member would have a circular head 18' as illustrated for instance in FIG. 10, as opposed to the rectilinear shaped head in cross section as shown in FIG. 9, then upper tongue or barb 42 is adpated to engage with the general underside of the grid member head generally adjacent the juncture of the web portion with the head 18' as shown, to lock or secure the clip member to the inverted T-bar grid member 10'.

It will be understood, of course, that the clip members illustrated in FIGS. 1 through 7 could likewise be adapted for coaction with a round headed T-bar 10' by generally shortening up on the distance between the top of the clasp section 26*a* or 26*a'* and the biting or gripping surface of the lower tongue portions 26*b* or 26*b'*, since the vertical dimension of the head of a round T-bar grid member is generally smaller than the vertical dimension of the head of the rectilinear type grid member illustrated in the aforementioned FIGS. 1 through 7.

From the foregoing discussion and accompanying drawings it will be seen that the invention provides novel clips for securing two T-bar grid beam members in generally perpendicular relation to one another in the formation of a ceiling grid, and a clip that is economical and may be mass produced. The invention also provides a grid assembly including clip means for holding a primary T-bar grid member in generally perpendicular relation to secondary T-bar grid members for a ceiling grid structure, for use for instance in suspended ceilings.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

What is claimed is:

1. A clip for securing two grid T-bar beam members in generally juxtaposed perpendicular relation to one another in the formation of a ceiling grid, each of the beam members being of inverted T-shaped configuration comprising an enlarged head portion, a generally vertical web portion and a pair of flange portions oppositely arranged and extending outwardly with respect to the web portion, said clip being of generally L-shape configuration in plan and having resilient clasp portions generally adjacent the distal ends of the legs of the L-configuration, each said clasp portion being of generally vertically oriented inverted U-shaped configuration in end elevation and having a tongue projecting diagonally inwardly and upwardly relative to the inverted U-shaped clasp configuration, said clasp portions being adapted to be forced downwardly into snap fastened, generally snug relation with the head portion of the respective beam member to secure the beam members in generally perpendicular juxtaposed relationship.

2. A clip in accordance with claim 1 wherein one leg of said L configuration is longer than the other leg thereof.

3. A clip in accordance with claim 1 wherein said tongue is partially severed from the clasp.

4. A clip in accordance with claim 1 wherein each of said clasp portions comprises a pair of said tongues partially severed therefrom, and disposed in spaced relation and obliquely with respect thereto, one arm of the inverted U configuration of each clasp portion being longer than the other arm thereof, said tongues being formed from said longer arm, said longer arm of each clasp portion being disposed laterally of the respective leg of the clip, with said other arm being generally coplanar with the respective leg of the clip.

5. A clip in accordance with claim 1 wherein said legs are generally vertically oriented longitudinally elongated straps adapted to run lengthwise of the associated beam member, with the respective clasp portion projecting laterally of the respective strap whereby the straps will generally hug the side of the head portion of the associated beam member when the clip is installed thereon.

6. A clip in accordance with claim 5 wherein one leg of said L-configuration is longer than the other leg thereof, whereby a pair of said clips can be utilized at the juncture of the associated beam members, one on each side of the juncture with one clip overlapping the other.

7. A clip in accordance with claim 1 formed from sheet metal and wherein said tongue is formed from a partially severed section of said clasp portion, one arm of the inverted U-configuration of each clasp portion being longer than the other arm thereof, with said tongue being formed from a partially severed section of said one arm of each said clasp portion, said one arm being disposed laterally of the respective leg of the clip, with said other arm being generally coplanar with the respective leg of the clip.

8. A clip in accordance with claim 7 wherein said legs are generally vertically oriented, longitudinally elongated straps, adapted to run lengthwise along a side of the head portion of the associated beam member, with one of said legs being longer than the other of said legs.

9. In a suspended ceiling construction for supporting ceiling panels including generally parallel arranged primary grid beam members and secondary cross support beam members disposed between adjacent ones of the primary beam members, each of said primary beam members and said secondary beam members being of inverted T-shaped configuration comprising an enlarged head portion, a generally vertical web portion and a pair of oppositely arranged outwardly extending, with respect to the web portion, flange portions, and wherein each of the secondary beam members is vertically supported at its flange portions on the underlying flange portion of the adjacent primary beam member, the combination therewith of a clip for securing the primary and secondary beam members together in generally perpendicular juxtaposed relation to one another, in the formation of the ceiling grid, said clip being of generally L-shaped configuration in plan and having resilient clasp portions generally adjacent the distal ends of the legs of the L-configuration, each said clasp portion being of generally vertically oriented inverted U-shaped configuration in end elevation and having a tongue projecting diagonally inwardly and upwardly relative to the inverted U-shaped clasp configuration, said clasp portions being forced downwardly from above and disposed in snap fastened generally snug relation with the head portion of the respective beam member and securing the generally juxtaposed primary and secondary beam members in said perpendicular relationship for connecting the beam members together.

10. A ceiling construction in accordance with claim 9 wherein one of said clip portions comprises an inverted generally U-shaped clasp including obliquely orientated inwardly extending tongue means, for locking the clip to the head of the primary beam member.

11. A ceiling construction in accordance with claim 9 wherein the clips are stamped from sheet metal.

12. A ceiling construction in accordance with claim 9 wherein said legs are generally vertically oriented longitudinally elongated straps running lengthwise of a side of the head portion of the respective beam member and generally hugging the latter, with the respective clasp portion projecting laterally of the respective strap and snugly engaging the head portion of the respective beam member, one arm of the inverted U-configuration of each clasp portion being longer than the other arm thereof, with said tongue being formed from a partially severed section of said one arm, said one arm being disposed laterally of the respective leg of the clip, with said other arm being generally coplanar with the respective leg of the clip.

13. A ceiling construction in accordance with claim 12 wherein one leg of said L-configuration is longer than the other leg thereof, and wherein a pair of said clips are utilized at the intersection of said primary and secondary beam members, one clip on each side of said intersection, with a leg of one of said pair of clips overlapping a clasp portion of the other of said pair of clips, said web portions of said beam members being non-apertured so far as clip attaching purposes are concerned with said snap fastened coaction as provided by said tongue, between said clasp portions and said beam members providing the sole connection of said clips to the beam members.

* * * * *